US010965032B2

(12) United States Patent
Leung et al.

(10) Patent No.: US 10,965,032 B2
(45) Date of Patent: Mar. 30, 2021

(54) DIELECTRIC RESONATOR ANTENNA

(71) Applicant: City University of Hong Kong, Kowloon (HK)

(72) Inventors: Kwok Wa Leung, Kowloon Tong (HK); Yong Mei Pan, New Territories (HK); Lei Guo, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 45 days.

(21) Appl. No.: 15/864,288

(22) Filed: Jan. 8, 2018

(65) Prior Publication Data

US 2019/0214732 A1 Jul. 11, 2019

(51) Int. Cl.

| | |
|---|---|
| ***H01Q 9/04*** | (2006.01) |
| ***H01Q 1/38*** | (2006.01) |
| ***H01Q 1/22*** | (2006.01) |
| *H01Q 1/48* | (2006.01) |

(52) U.S. Cl.

CPC ..... *H01Q 9/0492* (2013.01); *H01Q 1/2291* (2013.01); *H01Q 1/38* (2013.01); *H01Q 9/0485* (2013.01); *H01Q 1/48* (2013.01)

(58) Field of Classification Search

CPC ..... H01Q 1/38; H01Q 9/0407; H01Q 9/0421; H01Q 1/48; H01Q 9/01; H01Q 9/28; H01Q 9/285

USPC ..... 343/700 MS, 793, 795, 846

See application file for complete search history.

(56) References Cited

U.S. PATENT DOCUMENTS

| | | | | |
|---|---|---|---|---|
| 6,323,808 | B1 | 11/2001 | Heinrichs et al. | |
| 6,466,178 | B1 | 10/2002 | Muterspaugh | |
| 6,531,991 | B2 | 3/2003 | Adachi et al. | |
| 6,900,764 | B2 | 5/2005 | Kingsley et al. | |
| 7,443,363 | B2 | 10/2008 | Ying | |
| 7,843,389 | B2 | 11/2010 | Luk et al. | |
| 7,999,749 | B2 | 8/2011 | Ying | |
| 2003/0043075 | A1* | 3/2003 | Bit-Babik | H01Q 1/243 343/700 MS |
| 2005/0017903 | A1* | 1/2005 | Ittipiboon | H01Q 9/0485 343/700 MS |
| 2009/0102739 | A1* | 4/2009 | Chang | H01Q 1/2291 343/846 |
| 2010/0103061 | A1 | 4/2010 | Yung et al. | |
| 2012/0212386 | A1* | 8/2012 | Massie | H01Q 1/243 343/850 |
| 2018/0115072 | A1* | 4/2018 | Pance | H01Q 9/0485 |
| 2018/0323514 | A1* | 11/2018 | Pance | H01Q 21/0093 |
| 2019/0020105 | A1* | 1/2019 | Pance | H01Q 21/061 |

FOREIGN PATENT DOCUMENTS

| | | | | |
|---|---|---|---|---|
| GB | 2396746 A * | 6/2004 | | H01Q 9/0485 |

* cited by examiner

*Primary Examiner* — Daniel Munoz

(74) *Attorney, Agent, or Firm* — Renner Kenner Greive Bobak Taylor & Weber

(57) ABSTRACT

A dielectric resonator antenna includes a dielectric resonator element, a ground plane, and a conductive feeding arrangement. The ground plane is connected with the dielectric resonator element, and is operable to generate a first electromagnetic radiation. The conductive feeding arrangement is operable to generate a second electromagnetic radiation. During operation, simultaneous generation of the first electromagnetic radiation and the second electromagnetic radiation provides a unilateral electromagnetic radiation.

20 Claims, 13 Drawing Sheets

E plane (x-z plane)

H plane (x-y plane, θ = 90°)

E plane (x-z plane)

H plane (x-y plane, θ = 90°)

Front-view

Top-view

DIELECTRIC RESONATOR ANTENNA

TECHNICAL FIELD

The invention relates to a dielectric resonator antenna and particularly, although not exclusively, to a unilaterally radiating dielectric resonator antenna with a compact configuration.

BACKGROUND

Laterally radiating antenna can direct radiation in the desired lateral direction and suppress radiation in the opposite direction. With relatively low backward radiation, laterally radiating antenna can desirably reduce power waste and diminish interference with other devices. Therefore, laterally radiating antennas are desirable for applications where the communication object or required coverage range is beside the antenna, such as cordless phones and Wi-Fi routers that are placed in front of a wall.

Problematically, however, existing laterally radiating antenna structures for unilateral radiation have complex designs, and so are rather bulky and difficult to make. There is a need to provide an improved laterally radiating antenna that is particularly adapted for use in modern wireless communication systems.

SUMMARY OF THE INVENTION

In accordance with a first aspect of the invention, there is provided a dielectric resonator antenna, comprising: a dielectric resonator element; a ground plane connected with the dielectric resonator element, operable to generate a first electromagnetic radiation; and a conductive feeding arrangement, operable to generate a second electromagnetic radiation; wherein, during operation, simultaneous generation of the first electromagnetic radiation and the second electromagnetic radiation provides a unilateral electromagnetic radiation. The ground plane refers to an electrically conductive surface that is connected to ground, and it does not have to be strictly planar. The first and second electromagnetic radiations are preferably complementary.

Preferably, the first electromagnetic radiation is directed to a first direction and the second electromagnetic radiation is directed to a second direction substantially perpendicular to the first direction. For example, the first direction may be in the y-direction (Cartesian coordinates) and the second direction may be in the z-direction (Cartesian coordinates).

Preferably, the first electromagnetic radiation comprises a magnetic dipole. The magnetic dipole may be, for example, a y-directed magnetic dipole (Cartesian coordinates).

Preferably, the ground plane is arranged to excite a dielectric resonator mode for generation of the first electromagnetic radiation. The dielectric resonator mode may be $TE_{111}$ mode.

Preferably, the ground plane is in the form of a patch. The patch may be generally flat.

Preferably, the ground plane is provided on a dielectric substrate.

Preferably, an angular position or orientation of the ground plane relative to the dielectric resonator element is adjustable, for steering the unilateral electromagnetic radiation.

Preferably, a footprint of the ground plane is less than 50% of a footprint of the dielectric resonator element. More preferably, a footprint of the ground plane is less than 20% of a footprint of the dielectric resonator element.

Preferably, the second electromagnetic radiation comprises electric dipole. The electric dipole may be formed by, for example, z-directed electric monopole mode in the conductive feeding arrangement.

Preferably, the conductive feeding arrangement is received in the dielectric resonator element, and optionally, also arranged centrally of the dielectric resonator element.

Preferably, the conductive feeding arrangement comprises a feeding probe, which may be in the form any of: a cylindrical probe, a conical probe, an inverted conical probe, and a stepped cylindrical probe.

Preferably, the feeding probe is an inner conductor of a cable. The cable may further comprise an outer conductor operably connected with the ground plane, and the inner and outer conductors are co-axial.

Preferably, the dielectric resonator element comprises a cuboidal body defining a space therein for at least partly receiving the conductive feeding arrangement. The cuboidal body may include squared- or rectangular-cross section. The space preferably corresponds to the shape and form of the conductive feeding arrangement.

Preferably, the conductive feeding arrangement is substantially perpendicular to a wall of the dielectric resonator element. Preferably, the conductive feeding arrangement is or is also substantially perpendicular to the ground plane. The ground plane and the wall may be generally parallel.

Preferably, the dielectric resonator antenna is arranged to operate at LTE band, in particular, the 3.5 GHz LTE band.

In accordance with a second aspect of the invention, there is provided a dielectric resonator antenna array comprising one or more of the dielectric resonator antenna of the first aspect.

In accordance with a third aspect of the invention, there is provided a wireless communication system comprising one or more of the dielectric resonator antenna of the first aspect.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENT

Figure 1:
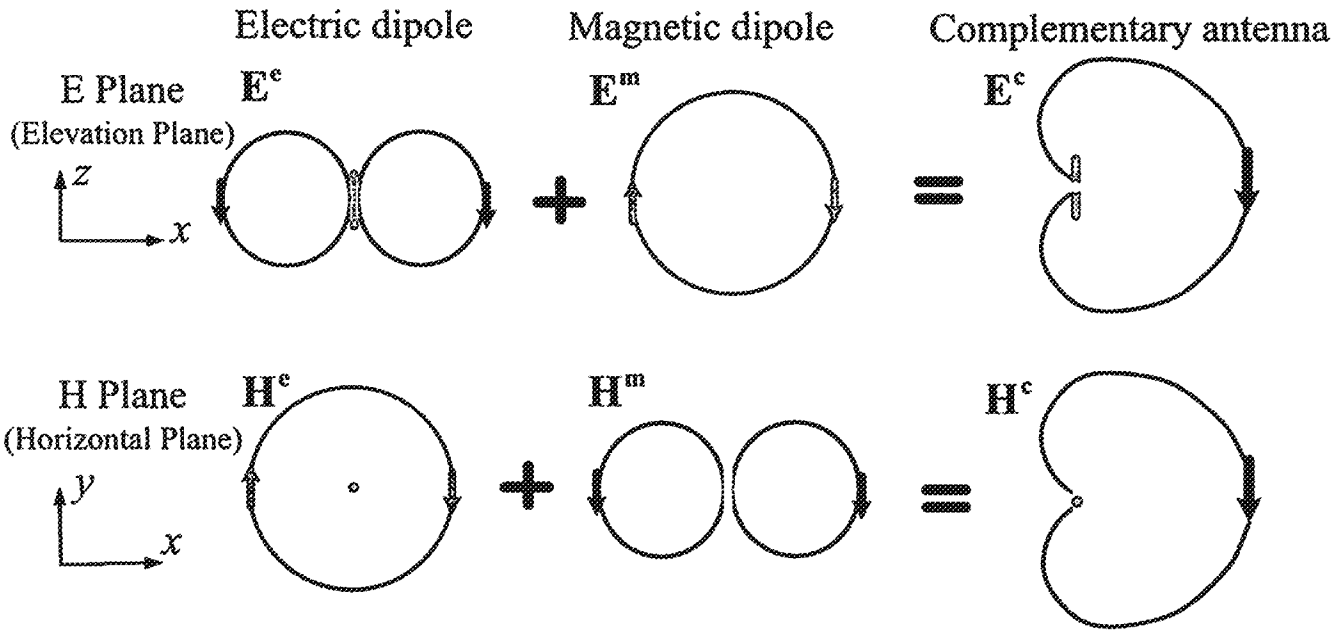
FIG. 1 is a schematic diagram illustrating the basic principle of complementary unilateral antenna.

FIG. 1 shows the basic principle of complementary unilateral antenna. As shown in FIG. 1, the E- and H-plane radiation patterns of an electric dipole are of "∞" and "O" shapes respectively; and the E- and H-plane radiation patterns of an magnetic dipole are of "O" and "∞" shapes respectively. In other words, the electric dipole and magnetic dipole are of complementary radiation patterns. In this example, a z-directed electric dipole and a y-directed magnetic dipole have a constructive interference in x direction and a destructive interference in −x direction (i.e., they substantially cancel each other). The net result is a lateral unidirectional radiation pattern with good front-to-back ratios (FTBRs) obtained in both radiation planes.

Thematically, the total far field of a pair of orthogonal electric and magnetic dipoles can be obtained by superimposing their individual far field because their fields are orthogonal to each other. In one example, the total $E_\theta$ and $E_\varnothing$ components of a z-directed electric dipole (length $l_e$, current amplitude $I_e$) and a y-directed magnetic dipole (length $l_m$, current amplitude $I_m$) are given by $$E_{T\theta} = \frac{k}{4\pi r} e^{j\omega[t-(r/c)]}(jnI_e l_e \sin\theta - e^{j\delta} jI_m l_m \cos\phi) \tag{1}$$

$$E_{T\phi} = \frac{k}{4\pi r} e^{j\omega[t-(r/c)]} e^{j\delta} jI_m l_m \cos\theta \sin\phi \tag{2}$$

where $k=\omega\sqrt{\mu_0\varepsilon_0}$ is the wave number and δ is the phase difference of the two currents. When $\eta l_e I_e = l_m I_m = II$ and δ=180°, the total fields can be simplified as:

$$E_{T\theta} = \frac{jk}{4\pi r} e^{j\omega[t-(r/c)]} Il(\sin\theta + \cos\phi) \tag{3}$$

$$E_{T\phi} = \frac{-jk}{4\pi r} e^{j\omega[t-(r/c)]} Il\cos\theta \sin\phi \tag{4}$$

According to equations (3) and (4), the co- and cross-polarized fields of the E-plane (xz-plane, Ø=0°, 180°) and H-plane (xy-plane, θ=90°) are given by:

Co-Polarized Fields:

$$|E_{T\theta}|(\text{E-plane}) \propto |H_{T\varnothing}|(\text{H-plane}) \propto (\sin\theta + \cos\varnothing) \tag{5}$$

Cross-Polarized Fields:

$$|E_{T\varnothing}|(\text{E-plane}) \propto |H_{T\theta}|(\text{H-plane}) \propto \cos\theta \sin\varnothing \tag{6}$$

It can be determined from equation (5) that the co-polarized fields of both planes are maximum in the +x direction but vanish in the −x direction. As a result, a cardioid-shaped unilateral pattern with a large front-to-back (F/B) ratio can be obtained. It can be determined from equation (6) that the cross-polarized fields vanish in both planes.

The above analysis is based on magnetic and electric dipoles with ideal behavior. However, in practice, the vanishing fields can be of finite values (although still relatively small).

Figure 2:
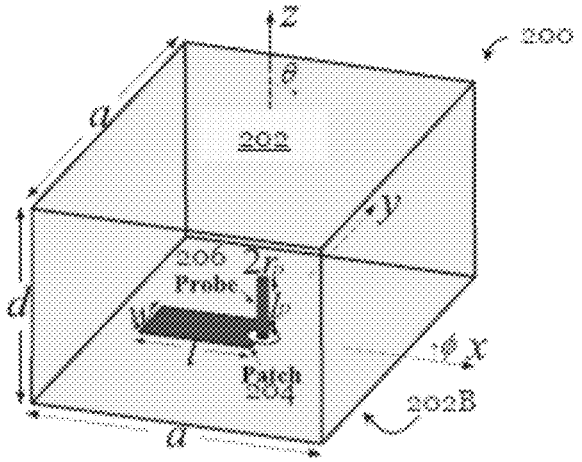
FIG. 2 is a schematic diagram of a dielectric resonator antenna in one embodiment of the invention.

FIG. 2 shows a dielectric resonator antenna 200 in one embodiment of the invention. The antenna 200 generally includes a dielectric resonator element 202, a ground plane 204 (electrically conductive surface connected to ground), and a conductive feeding arrangement 206. The ground plane 204 is arranged to generate a first electromagnetic radiation, preferably in the form of a magnetic dipole. The conductive feeding arrangement 206 is arranged to generate a second electromagnetic radiation, preferably in the form of an electric dipole. The first electromagnetic radiation may be directed substantially perpendicularly to the second electromagnetic radiation. During operation, simultaneous generation of the first electromagnetic radiation and the second electromagnetic radiation provides a unilateral electromagnetic radiation, making the antenna 200 a unilateral dielectric resonator antenna.

The dielectric resonator element 202 has a generally cuboidal body. The body defines a space for at least partly receiving the conductive feeding arrangement 206. The space is arranged centrally of the dielectric resonator element 202.

The ground plane 204 is in the form of a patch, and it is attached to a base wall 202B of the dielectric resonator element 202, extending generally parallel to the base wall 202B. In some embodiment, the ground plane 204 may be provided on a dielectric substrate (not shown). In the present embodiment, the ground plane 204 is arranged to excite a dielectric resonator mode for generation of the first electromagnetic radiation. The dielectric resonator mode may be $TE_{111}$ mode. By adjusting the angular position or orientation of the ground plane 204 relative to the dielectric resonator element 202, the radiation pattern can be steered or adjusted. A footprint of the ground plane 204 is preferably less than 50%, and more preferably less than 20%, of a footprint of the dielectric resonator element 202.

The conductive feeding arrangement 206 is a feeding probe of generally cylindrical form. The probe is received in the space defined by the body of the dielectric resonator element 202. The probe is arranged substantially perpendicular to both the base wall 202B of the dielectric resonator element 202 and the ground plane 204. The feeding probe 206 is an inner conductor of a cable, which may further include an outer conductor operably connected with the ground plane 204. Preferably, the inner and outer conductors of the cable are coaxial.

In the present embodiment, the electric and magnetic dipoles are integrated in a single dielectric resonator antenna 200.

As shown in FIG. 2, the dielectric resonator element 202 has a square cross section with a side length a, height d, and dielectric constant $\varepsilon_r$. The dielectric resonator element 202 is excited in the $TE_{111}$ mode by a small rectangular conducting patch (which forms the ground plane 204) with dimensions of length l and width w. In this example, the $TE_{111}$ mode provides the required equivalent y-directed magnetic dipole.

A feeding probe 206 of length (i.e., height) $l_p$ and radius $r_p$ is inserted into the dielectric resonator element 202 at the center to provide the required z-directed electric monopole mode. An outer conductor coaxial with the probe and belonging to the same cable as the probe is connected to the ground patch 204. In the present example, the field of the $TE_{111}$ mode changes with the angular position or orientation (or displacement) of the ground patch 204, the unilateral radiation pattern can be easily steered in the horizontal plane by altering the position or orientation of the patch 204.

Figure 3A:
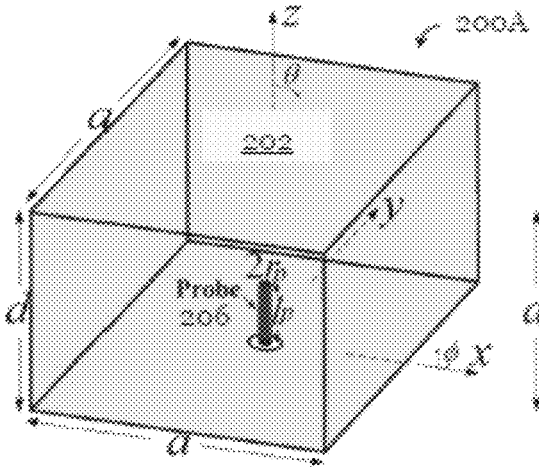
FIG. 3A is a schematic diagram of a first antenna arrangement (Antenna I) of the dielectric resonator antenna of FIG. 2.
Figure 3B:
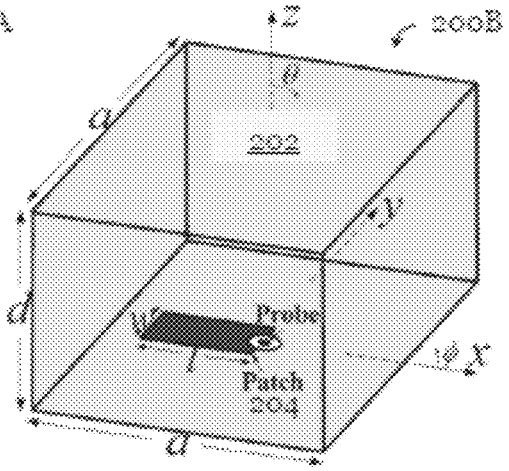
FIG. 3B is a schematic diagram of a second antenna arrangement (Antenna II) of the dielectric resonator antenna of FIG. 2.

To illustrate the operation of the antenna 200, FIGS. 3A and 3B provides two antenna arrangements of the dielectric resonator antenna of FIG. 2. FIG. 3A shows the first antenna arrangement 200A, Antenna I, with the ground patch 204 removed. FIG. 3B shows a second antenna arrangement 200B, Antenna II, with the probe removed (probe length $l_p$=0 mm).

Figure 4A:
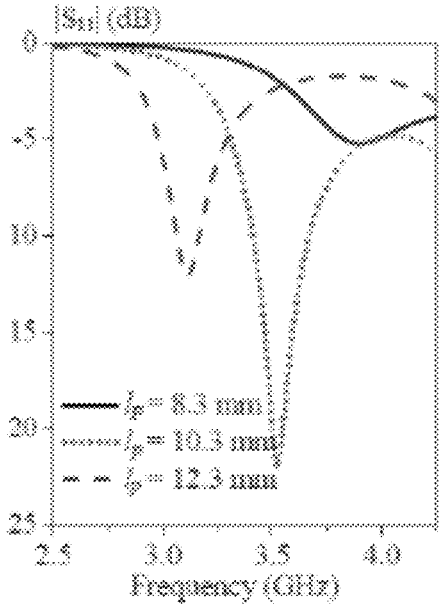
FIG. 4A is a plot showing variation of simulated reflection coefficient (dB) in the first antenna arrangement of FIG. 3A with frequency (GHz) for different probe length $l_p$ (8.3 mm, 10.3 mm, and 12.3 mm)
Figure 4B:
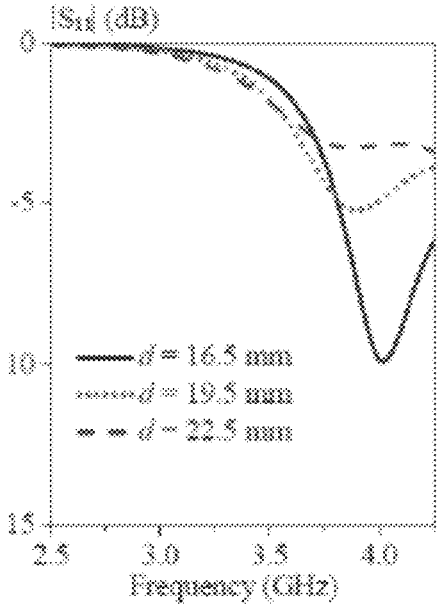
FIG. 4B is a plot showing variation of simulated reflection coefficient (dB) in the first antenna arrangement of FIG. 3A with frequency (GHz) for different dielectric resonator element height d (16.5 mm, 19.5 mm, and 22.5 mm)

FIGS. 4A and 4B show simulated reflection coefficient of Antenna I for different probe lengths $l_p$ (FIG. 4A) and dielectric resonator heights d (FIG. 4B). The following parameters are used in the simulation: $\varepsilon_r$=10, a=29 mm, and $r_p$=0.45 mm. The probe length $l_p$=8.3 mm, 10.3 mm, and 12.3 mm, with d=19.5 mm (FIG. 4A). The dielectric resonator element height d=16.5 mm, 19.5 mm, and 22.5 mm, with $l_p$=8.3 mm (FIG. 4B). As shown in FIGS. 4A and 4B, the resonant frequency decreases significantly from ~3.9 to 3.1 GHz as $l_p$ increases from 8.3 to 12.3 mm. However, it changes only slightly when d varies. This indicates that the resonance at 3.9 GHz is associated with the dielectric resonator-loaded probe (electric dipole mode).

Figure 5:
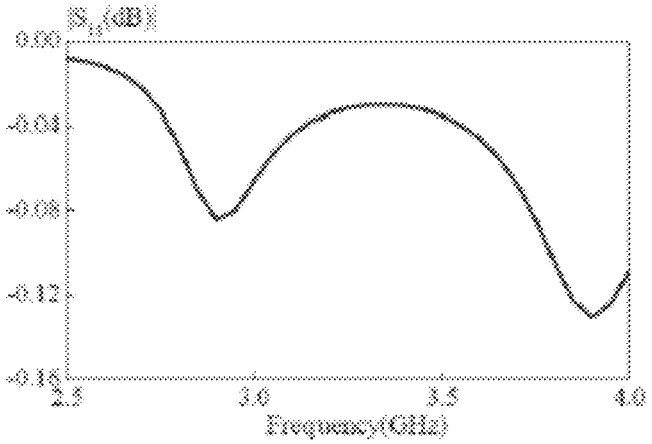
FIG. 5 is a plot showing variation of simulated reflection coefficient (dB) in the second antenna arrangement of FIG. 3B with frequency (GHz)
Figure 6B:
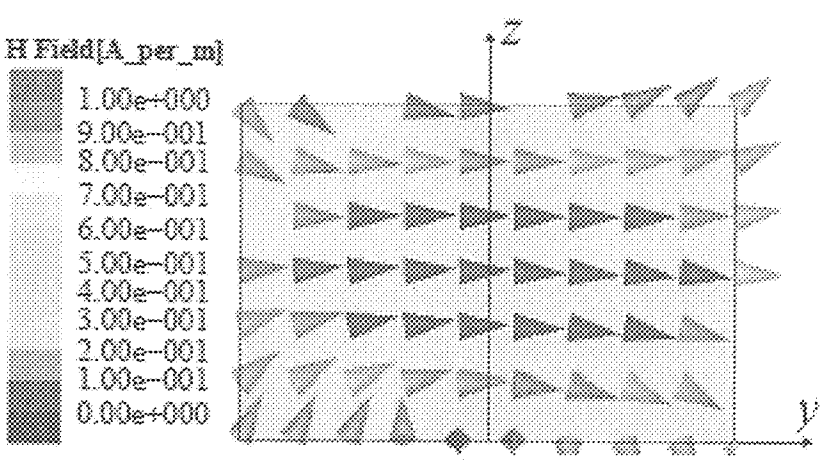
FIG. 6B is a plot showing simulated resonant H field in the second antenna arrangement of FIG. 3B at 2.9 GHz.
Figure 6A:
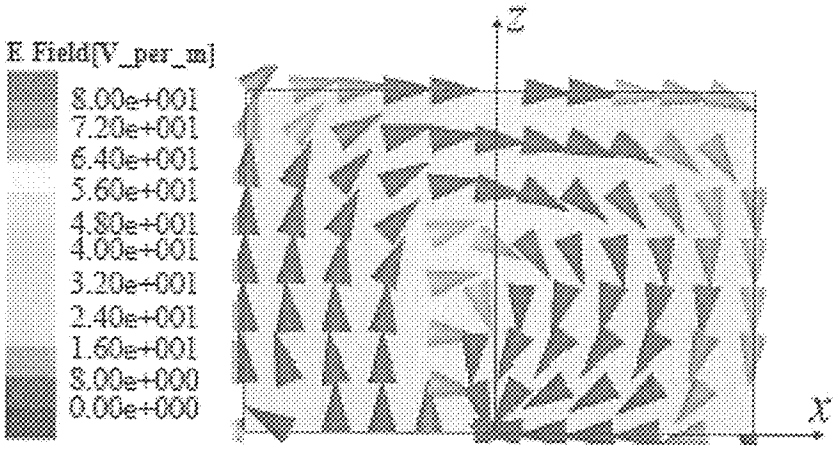
FIG. 6A is a plot showing simulated resonant E field in the second antenna arrangement of FIG. 3B at 2.9 GHz.
Figure 7A:
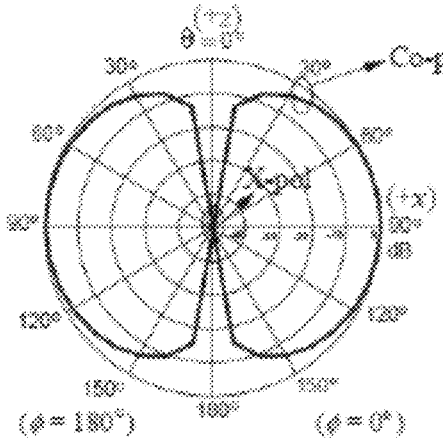
FIG. 7A is a plot showing simulated radiation pattern in the E plane (x-z plane) for the first antenna arrangement of FIG. 3A at 3.9 GHz.
Figure 7B:
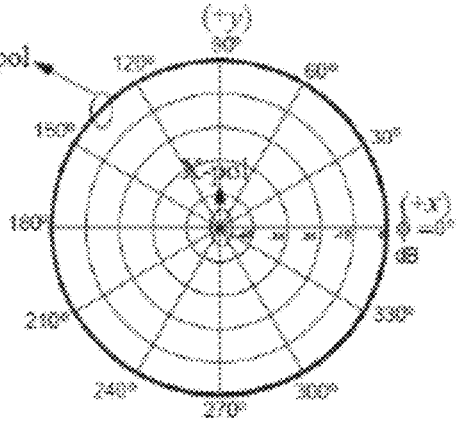
FIG. 7B is a plot showing simulated radiation pattern in the H plane (x-y plane) for the first antenna arrangement of FIG. 3A at 3.9 GHz.
Figure 7C:
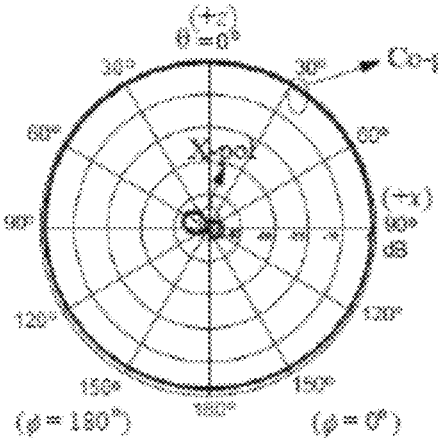
FIG. 7C is a plot showing simulated radiation pattern in the E plane (x-z plane) for the second antenna arrangement of FIG. 3B at 2.9 GHz.
Figure 7D:
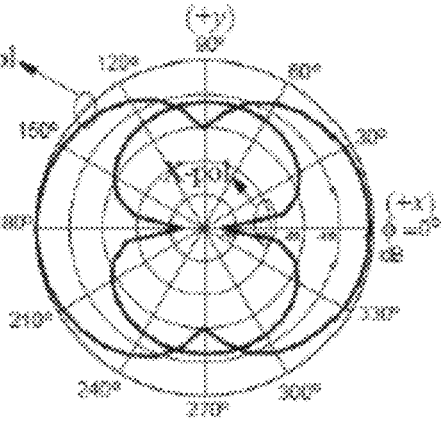
FIG. 7D is a plot showing simulated radiation pattern in the H plane (x-y plane) for the second antenna arrangement of FIG. 3B at 2.9 GHz.

FIG. 5 shows the simulated reflection coefficient of Antenna II. As shown in FIG. 5, two resonant modes with poor impedance match are found in Antenna II. The first resonant mode is found at ~2.9 GHz. FIGS. 6A and 6B show the simulated resonant E-field and H-field inside the dielectric resonator element. As shown in FIG. 6A, the E-field basically forms a loop but with slight distortion at the base caused by the patch. As shown in FIG. 6B, the H-field is mainly directed along the y direction. These results show that the first resonant mode found at ~2.9 GHz is the dominant $TE_{111}^{y}$ mode. On the other hand, the second resonant mode in FIG. 5 was found to be the higher-order $TE_{211}^{y}$ mode. This mode does not contribute to the required equivalent magnetic dipole mode.

FIGS. 7A to 7D show the simulated radiation patterns of Antennas I and II, respectively. As shown in FIGS. 7A to 7D, the radiation patterns of Antennas I and II are similar to those of a z-directed electric dipole and y-directed magnetic dipole, respectively. Thus, a unilateral radiation pattern can be obtained by combining them.

Figure 8:
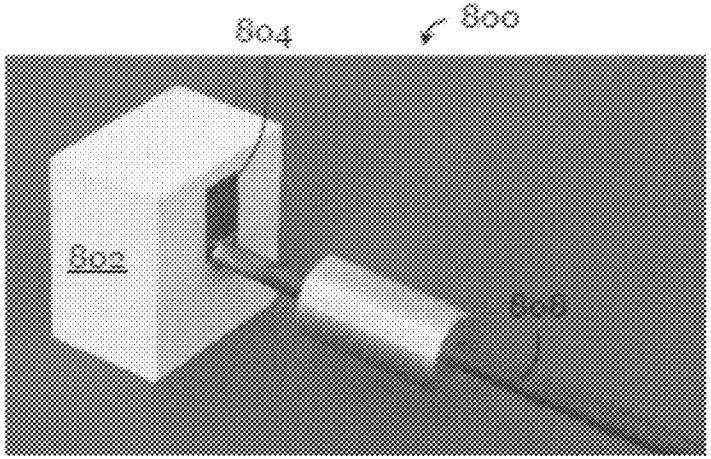
FIG. 8 is a photo showing a dielectric resonator antenna in one embodiment of the invention, fabricated based on the design illustrated in FIG. 2.

To demonstrate the above embodiment of the invention, a unilateral dielectric resonator antenna 800 covering 3.5-GHz LTE band was designed, fabricated, and tested. FIG. 8 shows a photograph of the prototype of a dielectric resonator antenna 800. This unilateral dielectric resonator antenna 800 was designed by ANSYS HFSS and fabricated by using an ECCOSTOCK HiK dielectric material. The dielectric resonator antenna 800 has parameters of $\varepsilon_r$=10, a=29 mm, d=19.5 mm, l=11.5 mm, w=7 mm, $r_p$=0.45 mm and $l_p$=8.3 mm, with loss tangent less than 0.002.

In the antenna 800 of FIG. 8, the ground plane 804 (patch) was fabricated using a piece of conducting adhesive tape. A semi-rigid coaxial cable 808 is connected to the ground plane 804 (patch), with its inner conductor (probe) inserted into the center of the dielectric resonator element 802 and the outer conductor connected to the patch 804 (ground). A balun is added to the coaxial cable 808 to suppress stray radiation from the cable. In other embodiments, the ground plane 804 (patch) can be printed on a dielectric substrate to enhance the mechanical robustness of the antenna. In this case, it would be necessary to re-optimize the antenna design for desired unilateral patterns.

Experiments were performed to obtain various parameters and measurements of the dielectric resonator antenna 800. In the experiments, the reflection coefficient was measured using an HP8510C network analyzer, whereas the radiation pattern, antenna gain, and antenna efficiency were measured with a Satimo Starlab System.

Figure 9:
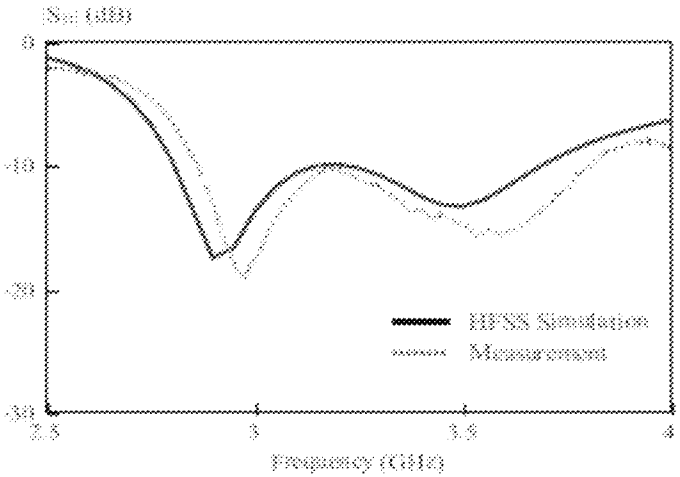
FIG. 9 is a plot showing simulated and measured reflection coefficients (dB) of the dielectric resonator antenna of FIG. 8 for different frequencies (GHz)

FIG. 9 shows the simulated and measured reflection coefficients of the dielectric resonator antenna prototype. As shown in FIG. 9, the measured 10-dB impedance bandwidth (|S11|<−10 dB) is 28.5% (2.86-3.81 GHz), which closely follows the simulated result of 27.0% (2.82-3.70 GHz). The small discrepancy is potentially caused by experimental imperfections and tolerances. The $TE_{111}^{y}$ mode of the dielectric resonator as found from Antenna II remains at around 2.9 GHz, despite the inclusion of the probe. This is reasonable in this example because the probe is located at the central part of the dielectric resonator element 802 where the E-field of the $TE_{111}^{y}$ mode is weak. In other words, the coupling between the probe and $TE_{111}^{y}$ mode is too small to obtain the probe effect. In this example, however, the probe frequency is 3.5 GHz, lower than 3.9 GHz as found in Antenna I, due to the loading of the patch.

It was found that the dielectric resonator antenna is a good unilateral antenna at 3.55 GHz. At this frequency, both the $TE_{111}^{y}$ and probe modes are not optimal—the former is not operated at its resonance frequency (2.9 GHz) whereas the latter is seriously loaded by the patch. Nevertheless, a unilateral radiation mode can be obtained as long as the conditions of $\eta l_e I_e = l_m I_m = II$ and $\delta = 180°$ as discussed above are met. The unilateral radiation mode so obtained would not be ideal (e.g., a finite F/B ratio) because the $TE_{111}^{y}$ mode (magnetic dipole) and probe mode (electric dipole) are not pure at this frequency.

Figures 10A, 10B:
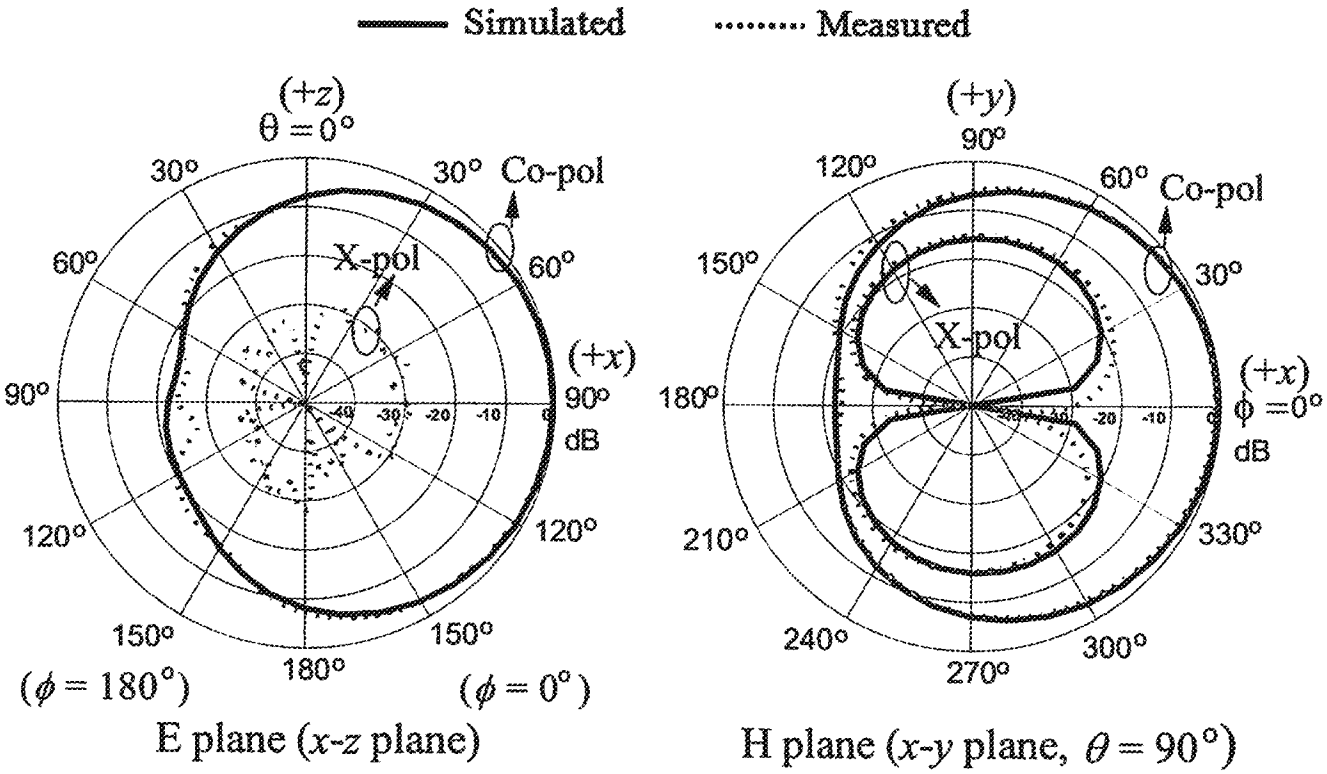
FIG. 10A is a plot showing simulated and measured radiation pattern in the E plane (x-z plane) for the dielectric resonator antenna of FIG. 8.
FIG. 10B is a plot showing simulated and measured radiation pattern in the H plane (x-y plane) for the dielectric resonator antenna of FIG. 8.
Figures 10C, 10D:
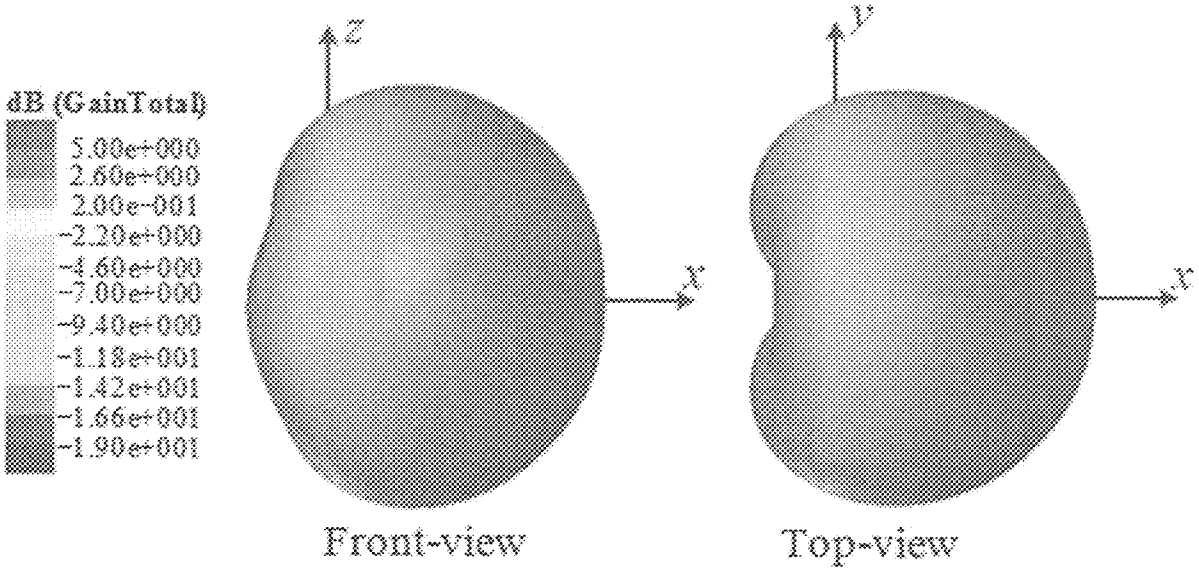
FIG. 10C is a plot showing simulated 3D radiation pattern (front view) for the dielectric resonator antenna of FIG. 8.
FIG. 10D is a plot showing simulated 3D radiation pattern (top view) for the dielectric resonator antenna of FIG. 8.

FIGS. 10A and 10B show the measured and simulated radiation patterns at 3.55 GHz. As shown in FIGS. 10A and 10B, both the E- and H-plane patterns are unilateral. The maximum radiation is found in the +x direction (θ=90, Ø=0°) with a high F/B ratio of ~25 dB. The co-polarized fields of both planes are stronger than their cross-polarized counterparts by more than 30 dB in the main (+x) direction. Radiation patterns at other frequencies were also studied. Very stable results were observed across the entire LTE passband (not shown). FIGS. 10C and 10D show the 3-D radiation patterns of the antenna. As shown, the power in the +x direction is much stronger than that in the −x direction, as expected.

Figure 11:
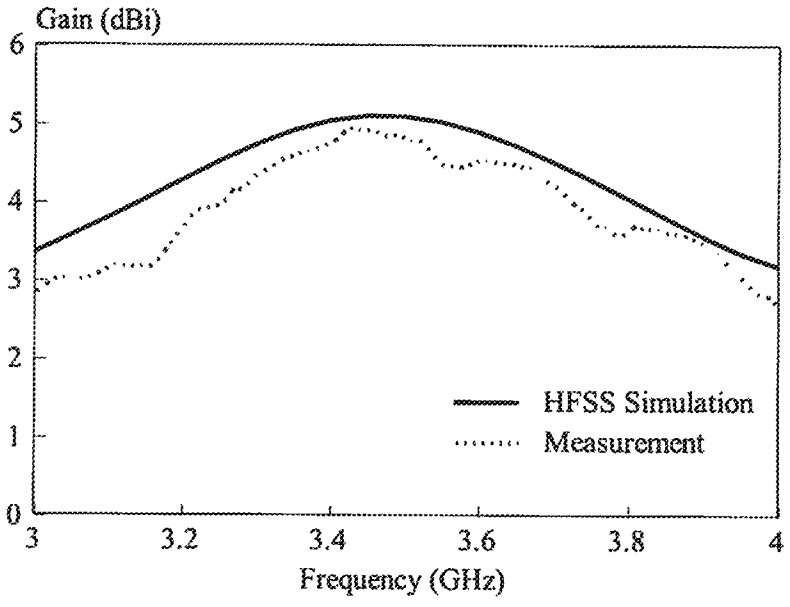
FIG. 11 is a plot showing simulated and measured antenna gains (dBi) of the dielectric resonator antenna of FIG. 8 for different frequencies (GHz)

FIG. 11 shows the measured and simulated antenna gains of the unilateral dielectric resonator antenna. As shown in FIG. 11, reasonable agreement between the measured and simulated results is observed. The measured gain is lower than the simulated result likely due to experimental imperfections. From FIG. 11, it can be seen that the measured gain varies between 4.43 dBi and 4.94 dBi over the LTE band.

Figure 12:
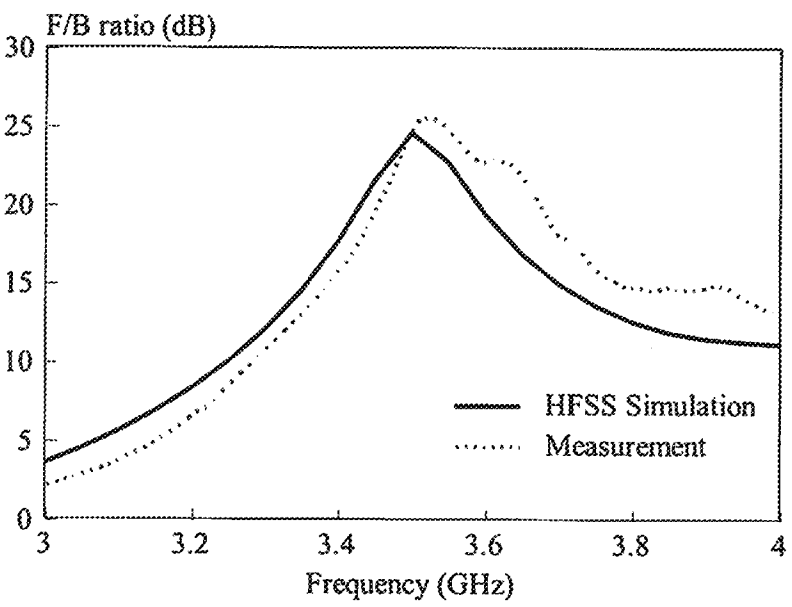
FIG. 12 is a plot showing simulated and measured front-to-back ratio (dB) of the dielectric resonator antenna of FIG. 8 for different frequencies (GHz)

FIG. 12 shows measured and simulated front-to-back (F/B) ratios of the dielectric resonator antenna. As shown in FIG. 12, the measured and simulated F/B ratios have their maximum values of ~25 dB, with the measured 15-dB F/B-ratio bandwidth given by 10.9% (3.39-3.78 GHz). Both measured and simulated F/B ratios are higher than 15 dB across the LTE band, which again verifies that the dielectric resonator antenna is a unilateral antenna with optimal performance. The efficiency of the dielectric resonator antenna was also measured, and it was found that the efficiency varies between 82% and 93% across the LTE band.

A comprehensive comparison between the unilateral dielectric resonator antenna in the present embodiment and the previous design in L. Guo, K. W. Leung, and Y. M. Pan, "*Compact unidirectional ring dielectric resonator antennas with lateral radiation,*" *IEEE Trans. Antennas Propag.*, vol. 63, no. 12, pp. 5334-5342, December 2015 is given in Table I. As shown in the Table, the current dielectric resonator antenna has a simpler feeding scheme and a more compact structure, with its bandwidth comparable to those of the previous design. Instead of using higher-order dielectric resonator modes ($HEM_{11\delta+1}$, $HEM_{11\delta+2}$) as found in the previous design, the fundamental TE111 mode is used for the dielectric resonator antenna of the present embodiment. This increases the antenna gain by ~1 dB in the desired lateral direction because the fundamental mode has a smaller radiation power density around the boresight direction (θ=0°).

TABLE I

Comparison between current unilateral dielectric resonator antenna and previous design

| Antenna | Feeding Scheme | Permittivity & Dimensions | Usable Bandwidth* | Average Gain |
|---|---|---|---|---|
| Original design in Guo et al. | using both the feeding slot and probe | $\varepsilon_r = 15$ $1.47 \times 1.20 \times 0.89\ \lambda_g^3$ | ~4% | ~3.7 dBi |
| Wideband design in Guo et al. | using both the feeding slot and probe | $\varepsilon_r = 15$ $2.17 \times 0.89 \times 1.63\ \lambda_g^3$ | ~14% | ~3.4 dBi |
| The present embodiment | using only the feeding probe | $\varepsilon_r = 10$ $1.08 \times 1.08 \times 0.73\ \lambda_g^3$ | 11% | ~4.6 dBi |

Figure 13A:
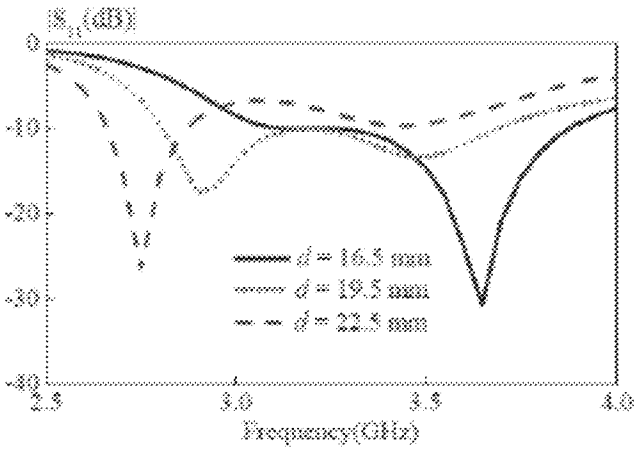
FIG. 13A is a plot showing variation of simulated reflection coefficient (dB) in the dielectric resonator antenna of FIG. 8 with frequency (GHz) for different dielectric resonator element height d (16.5 mm, 19.5 mm, and 22.5 mm)
Figure 13B:
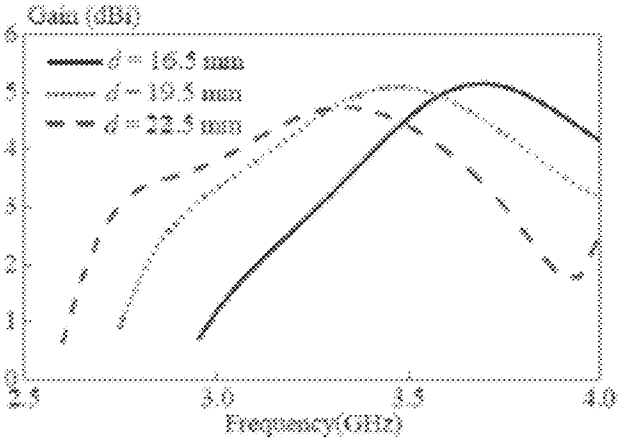
FIG. 13B is a plot showing variation of simulated antenna gain (dBi) in the dielectric resonator antenna of FIG. 8 with frequency (GHz) for different dielectric resonator element height d (16.5 mm, 19.5 mm, and 22.5 mm)
Figure 13C:
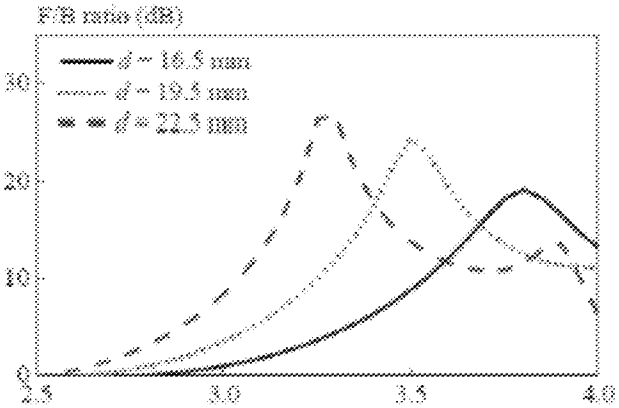
FIG. 13C is a plot showing variation of simulated front-to-back ratio (dB) in the dielectric resonator antenna of FIG. 8 with frequency (GHz) for different dielectric resonator element height d (16.5 mm, 19.5 mm, and 22.5 mm)

*Usable Bandwidth defined as the overlapping bandwidth between the 10-dB impedance passband and 15-dB F/B ratio passband A parametric study was carried out to characterize the unilateral dielectric resonator antenna. The effect of dielectric resonator size was studied. FIG. 13A shows the simulated reflection coefficient for d=16.5 mm, 19.5 mm, and 22.5 mm. As shown in FIG. 13A, increasing the dielectric resonator size would decrease the resonance frequencies. FIGS. 13B and 13C shows the corresponding simulated antenna gain and F/B ratio, respectively. As shown in FIGS. 13B and 13C, the frequencies of peak gain and F/B ratio shift downwards as d increases. This trend is consistent with that of the reflection coefficient. By comparing FIG. 13A with FIG. 13B, it can be found that the antenna gain increases with improving impedance match. The F/B ratio (FIG. 13C), however, conversely decreases with improving match. This is not surprising because the F/B ratio is mainly dependent on the relative amplitudes and phases of the magnetic and electric dipoles, not on the impedance match. The effect of the dielectric resonator sidelength a was also studied and similar results were observed (not shown)

The effect of the probe length $l_p$ was investigated. It was found that the frequency of the peak gain and F/B ratio decreases with an increase of $l_p$, showing that the operating frequency of the antenna can be tuned by changing $l_p$. It was also found that good F/B ratio and impedance match can be simultaneously obtained over the frequency range of 3.25-3.89 GHz, with the antenna bandwidth varying between ~2.7% and 9.6% as $l_p$ decreases from 10 to 6 mm.

The effects of the patch length l and width w were also studied. It was found that they can be used to adjust the impedance match and F/B ratio of the antenna, with the effect of l being much stronger than that of w.

Figure 14:
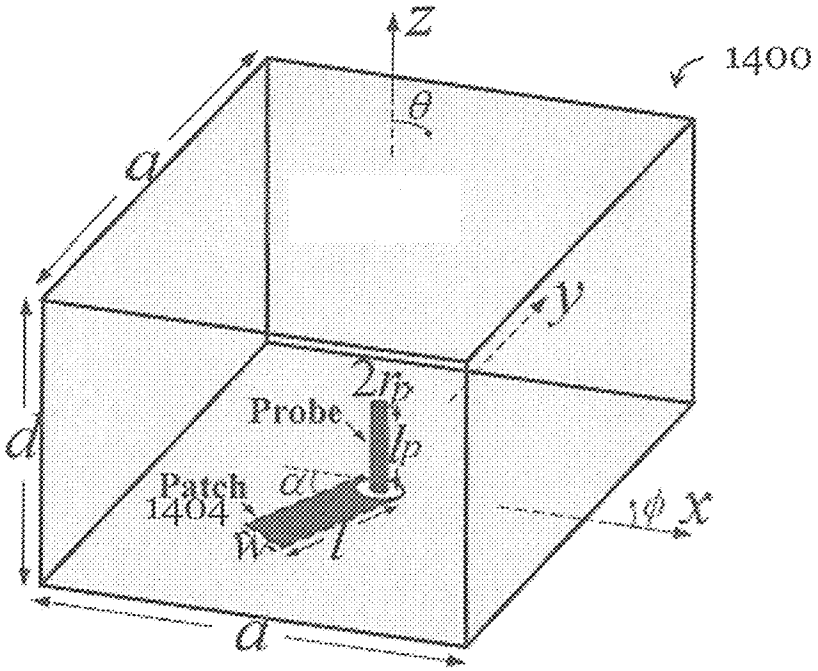
FIG. 14 is a schematic diagram of a dielectric resonator antenna in another embodiment of the invention, wherein the ground patch is angularly displaced (by displacement α) when compared with FIG. 2.

In one embodiment of the invention, the beam of the antenna can be steered in the azimuthal plane by changing the angular orientation or position (or displacement) of the ground patch. FIG. 14 shows a dielectric resonator antenna with a ground patch 1404 having an angular displacement α

(compared with that in FIG. 2). The construction of the dielectric resonator antenna 1400 is the same as the dielectric resonator antenna 200 of FIG. 2, except for the angular position of the ground patch 1404. Three cases of $\alpha$=0°, 45°, and 90° were studied.

Figure 15A:
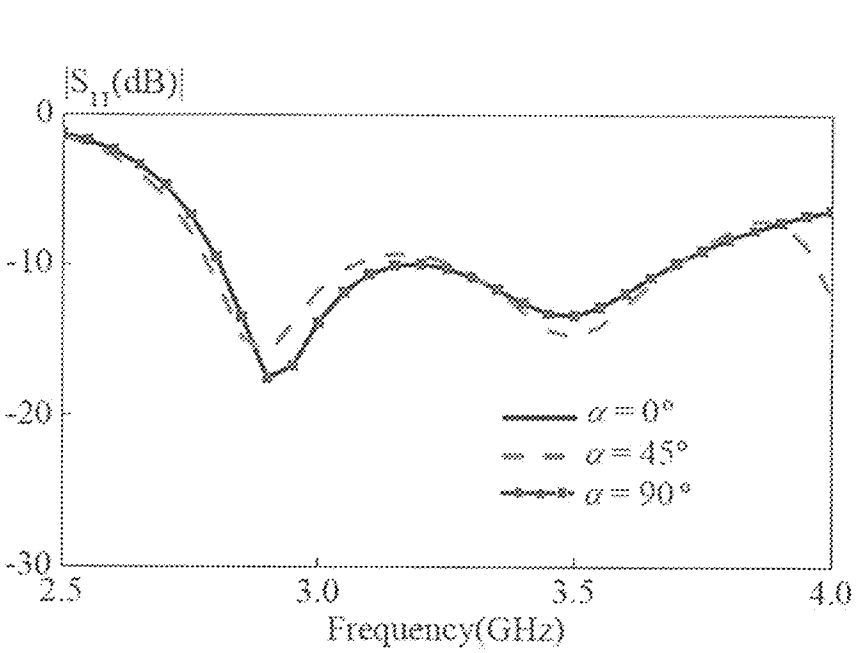
FIG. 15A is a plot showing variation of simulated reflection coefficient (dB) in the dielectric resonator antenna of FIG. 14 with frequency (GHz) for different angular displacement α (0°, 45°, and 90°)
Figures 15B, 15C:
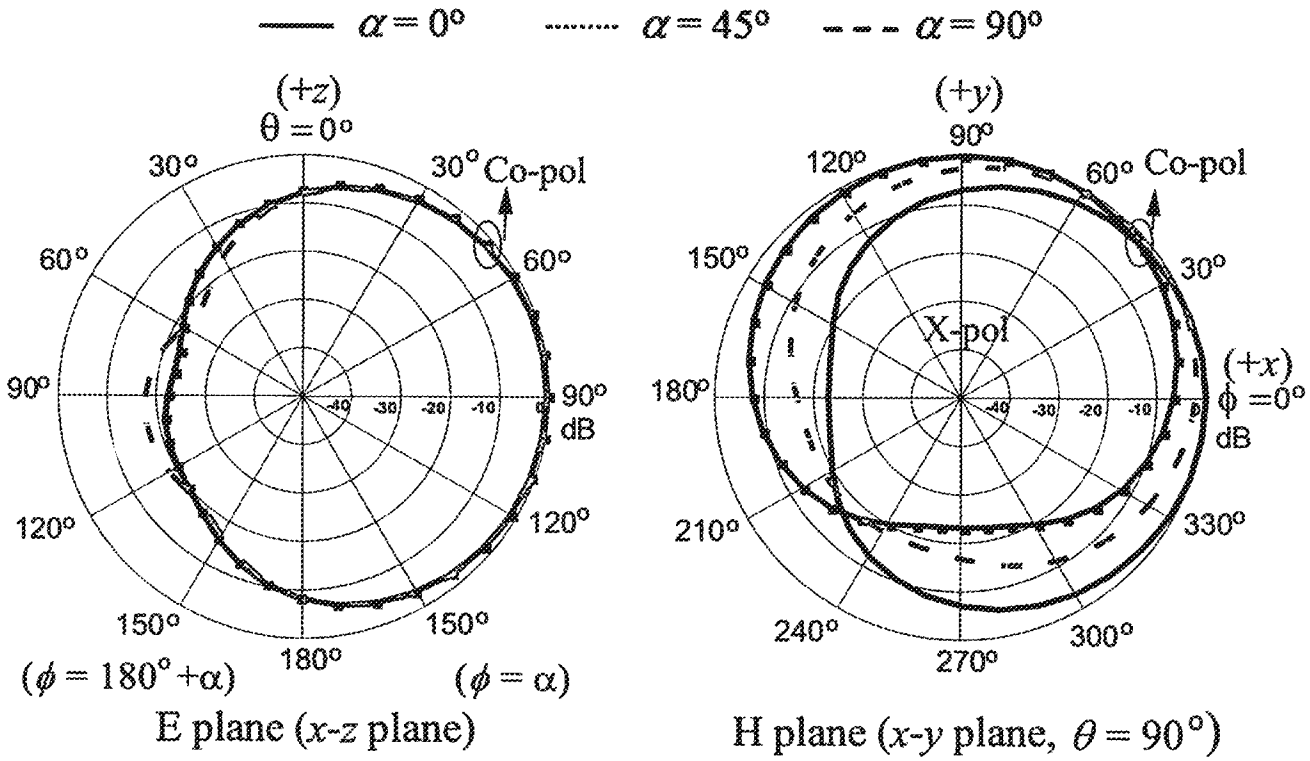
FIG. 15B is a plot showing simulated radiation pattern in the E plane (x-z plane) for the dielectric resonator antenna of FIG. 14 at 3.55 GHz for different angular displacement α (0°, 45°, and 90°)
FIG. 15C is a plot showing simulated radiation pattern in the H plane (x-y plane) for the dielectric resonator antenna of FIG. 14 at 3.55 GHz for different angular displacement α (0°, 45°, and 90°)

FIGS. 15A to 15C show the simulated reflection coefficient and radiation pattern, respectively. As shown in FIG. 15A, the results of $\alpha$=0°, 90° are the same due to symmetry of the structure. It can also be observed that the reflection coefficient of $\alpha$=450 is very similar to those of $\alpha$=0°, 90°. This is desirable because the steering can be readily made without substantially affecting matching. With reference to FIGS. 15B and 15C, the horizontal radiation pattern rotates as a increases but the vertical radiation pattern remains substantially unchanged. It should be noted that the maximum radiation direction is always opposite to the ground patch, i.e., the maximum radiation will occur at Ø=$\alpha$ when the angular displacement is a. Also, the cardioid shape is substantially maintained during steering.

Figure 16B:
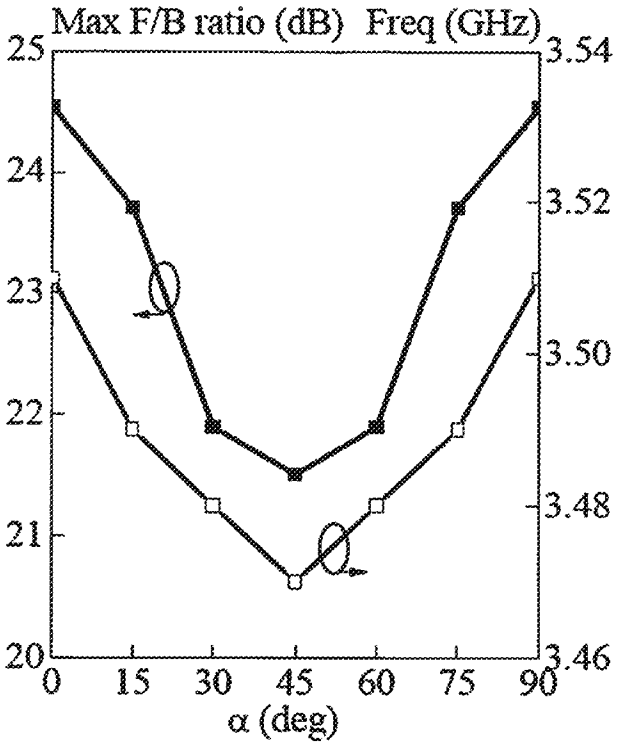
FIG. 16B is a plot showing variation of simulated maximum front-to-back ratio (dB) and its corresponding frequency (GHz) for the dielectric resonator antenna of FIG. 14 with the angular displacement α.
Figure 16A:
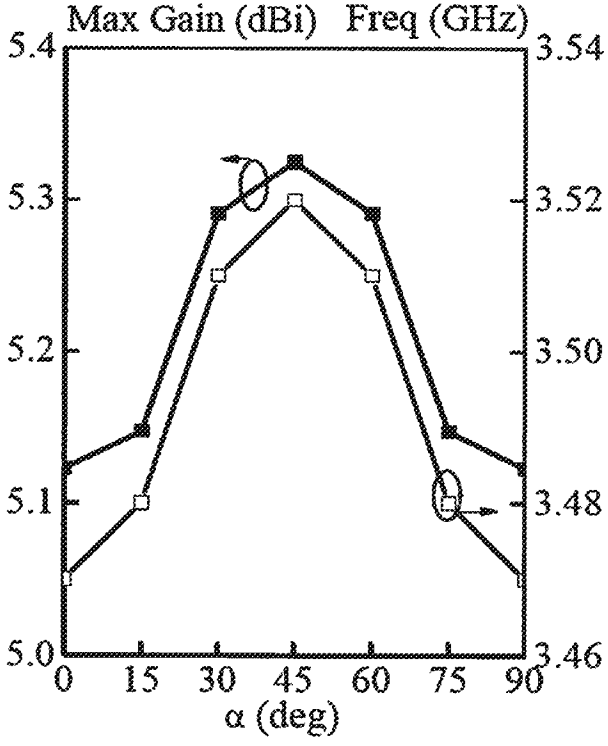
FIG. 16A is a plot showing variation of simulated maximum antenna gain (dBi) and its corresponding frequency (GHz) for the dielectric resonator antenna of FIG. 14 with the angular displacement α.

FIG. 16A shows the simulated maximum gain and its corresponding frequency as a function of $\alpha$. As shown in FIG. 16A, both the gain and frequency are symmetry about $\alpha$=45° due to the symmetry of the structure. As a increases from 0° to 45°, the maximum gain and corresponding frequency only slightly increase from 5.12 to 5.33 dBi and from 3.47 to 3.52 GHz, respectively. FIG. 16B shows the simulated maximum F/B ratio and its corresponding frequency as a function of a. Again, the variations are very small as a varies. All these results show that stable cardioid-shaped radiation pattern can be maintained when doing the steering.

The above embodiments of the invention have provided a simple laterally radiating rectangular dielectric resonator antenna that has a feeding probe and a small ground patch. In the illustrated embodiment, the dielectric resonator element is excited in its fundamental $TE_{111}$ mode to provide an equivalent magnetic dipole. This magnetic dipole is combined with the electric monopole of the feeding probe to give a lateral cardioid-shaped radiation pattern. The unilateral dielectric resonator antennas in the above embodiments have small ground plane and thus are compact. The antenna can be simply fed by the inner conductor of a SMA connector, omitting the need of complex feeding network. The antenna is largely made of dielectric and so the loss can be made small even at mm-wave frequencies. This in turn provides high radiation efficiency. Different bandwidths for different applications can be obtained, by selecting suitable dielectric constant to be used in the unilateral dielectric resonator antenna of the present invention. The lateral radiation pattern of the dielectric resonator antenna of the above embodiments can be easily steered in different horizontal directions by changing the angular position, orientation, or displacement of the ground patch, with no significant effects on impedance match.

It will be appreciated by persons skilled in the art that numerous variations and/or modifications may be made to the invention as shown in the specific embodiments without departing from the spirit or scope of the invention as broadly described. For example, the dielectric resonator element can be of any shape, not necessarily cuboidal. The ground plane can be of any shape and form. The probe can be of any shape and form, such as a conical probe, an inverted conical probe, and a stepped cylindrical probe. Any other dielectric resonator mode can be used to provide the equivalent magnetic dipole, not necessarily the fundamental $TE_{111}$ mode. The permittivity $\varepsilon_r$ of the dielectric resonator element can be of any value. The present embodiments are, therefore, to be considered in all respects as illustrative and not restrictive.

The invention claimed is:

1. A dielectric resonator antenna, comprising:

a dielectric resonator element with a body having a wall;

a ground plane in the form of a patch, attached to the wall of the dielectric resonator element, the ground plane being sized smaller than the wall of the dielectric resonator and being operable to be fed into and excite the dielectric resonator element to a dielectric resonator mode to generate a first electromagnetic radiation; and a conductive feeding arrangement comprising a feeding probe received in a space defined by the body and operable to be fed into and excite the dielectric resonator element to generate a second electromagnetic radiation different from and complementary to the first electromagnetic radiation;

wherein, during operation, simultaneous generation of the first electromagnetic radiation and the second electromagnetic radiation provides a unilateral electromagnetic radiation.

2. The dielectric resonator antenna of claim 1, wherein the first electromagnetic radiation is directed to a first direction and the second electromagnetic radiation is directed to a second direction substantially perpendicular to the first direction.

3. The dielectric resonator antenna of claim 1, wherein the first electromagnetic radiation comprises a magnetic dipole.

4. The dielectric resonator antenna of claim 1, wherein the dielectric resonator mode is $TE_{111}$ mode.

5. The dielectric resonator antenna of claim 1, wherein the ground plane is provided on a dielectric substrate.

6. The dielectric resonator antenna of claim 1, wherein an angular position or orientation of the ground plane relative to the dielectric resonator element is adjustable.

7. The dielectric resonator antenna of claim 1, wherein a footprint of the ground plane is less than 50% of a footprint of the dielectric resonator element.

8. The dielectric resonator antenna of claim 1, wherein a footprint of the ground plane is less than 20% of a footprint of the dielectric resonator element.

9. The dielectric resonator antenna of claim 1, wherein the second electromagnetic radiation comprises electric dipole.

10. The dielectric resonator antenna of claim 1, wherein the conductive feeding arrangement is arranged centrally of the dielectric resonator element.

11. The dielectric resonator antenna of claim 1, wherein the feeding probe comprises any of: a cylindrical probe, a conical probe, an inverted conical probe, and a stepped cylindrical probe.

12. The dielectric resonator antenna of claim 1, wherein the feeding probe is an inner conductor of a cable.

13. The dielectric resonator antenna of claim 12, wherein the cable further comprises an outer conductor operably connected with the ground plane, and the inner and outer conductors are co-axial.

14. The dielectric resonator antenna of claim 1, wherein the dielectric resonator element comprises a cuboidal body defining a space therein for at least partly receiving the conductive feeding arrangement.

15. The dielectric resonator antenna of claim 1, wherein the conductive feeding arrangement is substantially perpendicular to the wall of the dielectric resonator element.

16. The dielectric resonator antenna of claim 1, wherein the conductive feeding arrangement is substantially perpendicular to the ground plane.

17. The dielectric resonator antenna of claim 1, wherein the dielectric resonator antenna is arranged to operate at LTE band.

18. A dielectric resonator antenna array comprising one or more of the dielectric resonator antenna of claim 1.

19. A wireless communication system comprising one or more of the dielectric resonator antenna of claim 1.

20. The dielectric resonator antenna of claim 1, wherein the first electromagnetic radiation comprises a y-directed magnetic dipole and the second electromagnetic radiation comprises a z-directed electric dipole.

* * * * *